US005738353A

United States Patent [19]

Belcher

[11] Patent Number: 5,738,353

[45] Date of Patent: Apr. 14, 1998

[54] TRACK STAR RELAYS

[76] Inventor: Kerry L. Belcher, P.O. Box 1313, Chino, Calif. 91708

[21] Appl. No.: 831,192

[22] Filed: Apr. 2, 1997

[51] Int. Cl.[6] ..... A63F 3/00

[52] U.S. Cl. ..... 273/244

[58] Field of Search ..... 273/244, 246, 273/248, 249, 259

[56] References Cited

U.S. PATENT DOCUMENTS

| | | | |
|---|---|---|---|
| 3,997,167 | 12/1976 | Kratzer | 273/244 |
| 4,141,560 | 2/1979 | Kaslow | 273/244 |
| 4,583,741 | 4/1986 | Brisciano | 273/244 |
| 5,560,609 | 10/1996 | Grant | 273/246 |
| 5,662,325 | 9/1997 | Weyand | 273/246 X |

*Primary Examiner*—William E. Stoll

[57] ABSTRACT

A board game which simulates track and field sports. The game includes a playing board (12), board pieces (4A, 4B), runner figurines (3A to 3D), a pair of dice (7), sets of chance and challenge cards (5A to 6D), and a winner's purse of play money (8). The playing board (12), comprises a generally oval shaped running track (14), with separate lanes for numerous players to compete in a track meet. A track meet comprises a minimum of one relay, out of numerous possible relays, and optional solo sprints and steeplechases, having start blocks (20A to 20E) and finish lines (46, 17). Field events are optional, comprising a shot put (50A, 50B), javelin throw (60A, 60B), long jump (64A, 64B), and a triple jump (62A to 62C), having attainable world record scores. Players are represented by teams of relay runner figurines (3A to 3D) that are moved on the track (14), detour (30), by utilizing a pair of dice (7). The relay runners (3A to 3D), are labeled with identification mathematical formulas that are applied to the numbers appearing on the dice (7). This implements various movement speeds. During a relay race, a runner can hand off to a slower, faster or fastest runner on the same team. The track (14), detour (30), and offshoot (16), have symbols (22 to 38) inscribed throughout its pathway. This presents a player with chances for extra movement, to lose one turn, or to be a world record holder. Players race to a common finish (46, 17). World record holders, first, second, and third place finishers in each event, is awarded play money (8). Player with the most play money (8) at the end of the track meet, is the winner of the game.

4 Claims, 4 Drawing Sheets

TRACK STAR RELAYS

BACKGROUND—FIELD OF INVENTION

This invention relates to board games, specifically a board game to simulate the sport of professional track and field.

BACKGROUND—DESCRIPTION OF PRIOR ART

There are numerous board games that simulate track and field sports.

U.S. Pat. No. 3,997,167 to Kratzer, Dec. 14 (1976) discloses a board game that simulates track and field. The events presented in this invention, the 100 yard dash and the 220 yard dash are obsolete: They are no longer a part of current track and field sports, therefore this invention is unrealistic.

U.S. Pat. No. 4,141,560 to Kaslow, Feb. 27 (1979) discloses a board game that simulates many sports such as swimming, baseball, bicycling and track. This invention presents only one possible event to play pertaining to track; the 100 yard dash which is an outdated, obsolete event. There is not enough track and field competition in this invention to satisfy s player interested in playing a board game to simulate the sport of track and field.

U.S. Pat. No. 4,241,924 to Arcara, Dec. 30, (1980) shows a board game that simulates olympic events by utilizing a pair of dice to be thrown, so as to select a card that determines the score of an event shown on a playing board. The winner is the player with the highest score. This invention does not capture the excitement and competition of real track and field because; the real sport is mainly about a speed contest between runners, or a race to reach a common finish line. This invention is an unrealistic simulation.

U.S. Pat. No. 4,346,899 to Nuebling, Aug. 31, (1982) a board game which features olympic sports having track and field, water, winter and arena events. It uses a die, spinner, and cards to move game pieces about a playing board having a rectangular shaped pattern pathway. The player scoring the most points in a fixed amount of time or the player to score a set number of points is the winner. This invention lacks the true detailed simulation of track and field competition because the playing board pathway is not shaped in an oval pattern, unlike that of a genuine track and field pathway. This invention does not simulate the object of track and field competition in which runners move an equal distance and race to reach a common finish.

U.S. Pat. No. 4,583,741 to Brisciano, Apr. 22 (1986) shows a board game that simulated track and field. It used a pair of dice, board pieces and a playing board with an oval track pathway having separate lanes with a common starting line and a common finish line. This does not simulate a fair, or true pathway of track and field because the outermost lanes of this track will be longer in length from a common start line to a common finish than that of the inner lanes, therefore being unequal in running lengths. It had only one relay race possible to play utilizing four teammates in which a runner moves at a rate of speed no faster or slower than what is thrown on the dice. One runner hands off to the next runner that moves at the same rate of speed or pace. All four runners of this relay team move at the same pace or rate of speed. This is boring and unrealistic because the excitement of a real track and field relay is having four teammates that are able to move at distinctive rates of speed: One runner would move slow, the next would move fast, the next faster then fastest. This invention had events that are outdated, obsolete and are no longer a part of current track and field competition such as the 100 yard dash, 220 yard dash and the broad jump. This invention shows a winners circle where the player with the most pieces in the circle is the winner. The incentive to win in this invention does not equal the incentive used in current professional track and field which would be a purse or cash prize money.

All the games to simulate the sport of track and field heretofore known suffer from a number of disadvantages:

(a) The track pathway of the board games do not resemble that of a professional track and field pathway with a common finish in detail because the outermost lanes are longer in length than the inner lanes, therefore being unrealistic and would be unfair in real life.

(b) Having relay runners that all move at the same pace or the same rate of speed being unrealistic and boring unlike the real sport whereas relay runners have the ability to move or run at distinctive paces or rates of speed.

(c) Numerous events shown are outdated, obsolete and are no longer a part of current professional track and field sports, such as the 100 yard dash, 220 yard dash, and the broad jump.

(d) The track pathways having an oval shape comprise lanes that are divided into blank spaces for movement, with the exception of hurdles. This is too plain and boring for entertainment purpose.

(e) The incentives to win are about points, and a winners circle, which does not equal the incentive to win in current professional track and field which would be a winners purse of cash prize money.

Accordingly, several objects and advantages of my invention are:

(a) to provide a board game to realistically simulate a professional track and field stadium; Having details of an oval shaped track pathway with a convex curve being of a staggered cascading configuration for a start area, so as to provide lanes that are equal in length with a common finish; very similar to a real track.

(b) to provide numerous relay running events in which each relay runner of a team is labeled with a distinctive identification No. which is a mathematical formula: That will be applied to a pair Of dice, therefore implementing distinctive paces or rates of speed which will empower a player with strategy options such as; placing runners to hand off to a slower, faster or fastest relay runner. This relay will simulate the excitement and fun of a current professional track and field relay event.

(c) to provide numerous up-to-date popular main events of current track and field sports such as the 100 meter sprint, 200 meter sprint, 4×200 meter sprint relay, the steeplechase, long jump, and the triple jump. I have included extraordinary nevertheless current events such as 300 meter sprint. My board game features about 25 events possible to play, sure to satisfy a player in search of simulating track and field sports.

(d) to provide an oval shaped track pathway comprising lanes that are inscribed with numerous symbols. These symbols represent a chance to; lose 1 turn, or roll again, thereby implementing elements of acceleration, delay and exciting entertainment while moving on the track pathway.

(e) to provide a simulated winners purse for each event. Cash dollar prizes totaling over one million dollars in play money. The incentive to win in my invention, is very similar to that of a current professional track and field sporting event.

Other objects and advantages of my invention are:

to provide sets of chance cards which will implement interaction between a coach, official and a player.

to provide a set of chance/challenge cards which will present situations of risk, opportunities to advance and become a world record holder.

to provide hurdles being placed throughout various zones of the track; therefore implementing simulations of numerous hurdling events.

to provide starting blocks in fine detailed simulation of those used in professional track and field. Being placed throughout various zones of the track pathway in order to separately start numerous running events.

DRAWING FIGURES

In the drawings, closely related figures have the same number but different alphabetic suffixes.

REFERENCE NUMERALS IN DRAWINGS

| | |
|---|---|
| 12 game board | |
| 14 track pathway | 16 pathway offshoot |
| 17 finish line secondary | 18 staggered cascading curve |
| 20A to 20H starting block | 22 roll again |
| 24 lose 1 turn | 26 official |
| 28 coach | 29 track star |
| 32A to 32D detour arrow | 30 steeplechase detour |
| 34 hurdle | 36 triple hurdle |
| 38 water pool | 46 finish line primary |
| 50A to 50B shot put | 60A to 60B javelin throw |
| 62A to 62C triple jump | 64A to 64B long jump |
| 70 competition level | 80A to 80D relay waiting zone |

SUMMARY

A board game to simulate professional track and field sports having numerous relay, running and field events to form a track meet. Numerous players utilize relay runner figurines, a pair of dice, and elements of chance to compete for a simulated cash dollar purse. The player with the most play money, at the end of the track meet, is the winner of the game.

Figure 1:
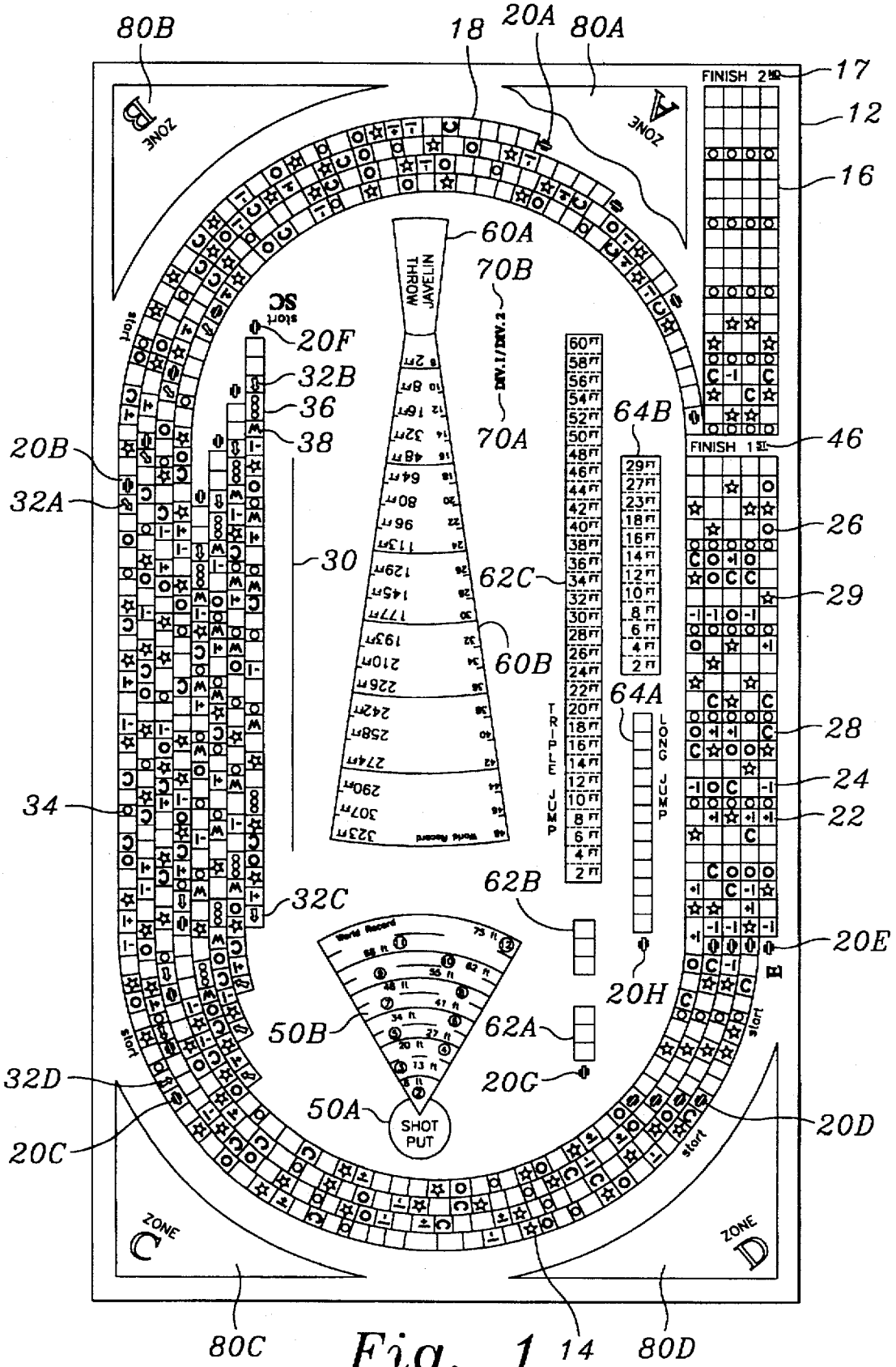
FIG. 1 shows a top plan view of the game board of the present invention.

Description—FIGS. 1 to 8 referring now to FIG. 1

Game board depicts a track and field stadium simulation on which many sporting events will be played.

Figure 2:
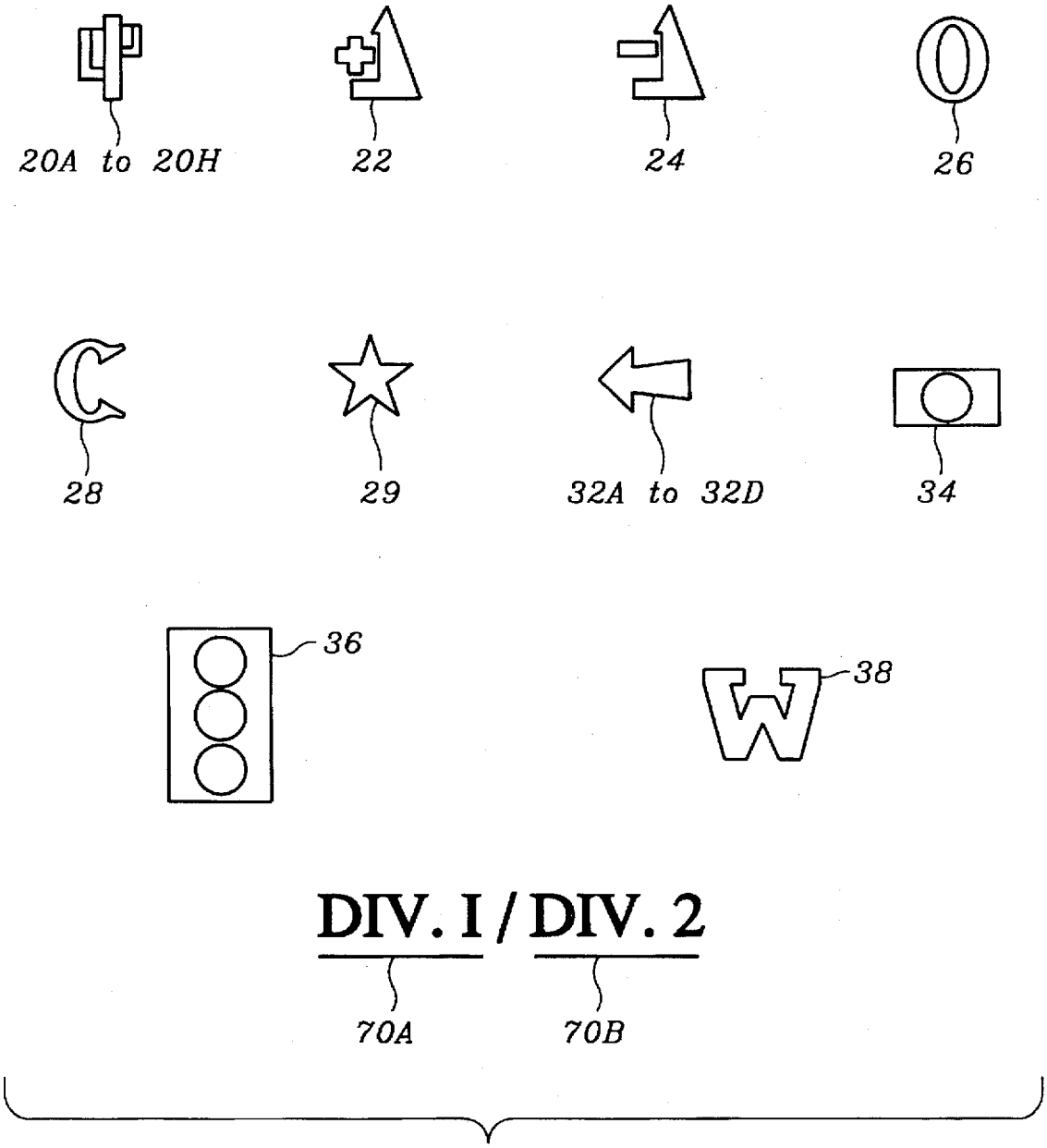
FIG. 2 shows a detail view on a larger scale of symbols which are inscribed on the track pathways of game board FIG. 1.

A main running track pathway 14 comprise four lanes for four players that are four distinctive colors. Track 14 is of an oval pattern shape having two straight sides and two convex curves. A straight side has a pathway offshoot 16. Another straight side has a steeplechase detour pathway 30 placed adjacent to and surrounded by track 14. A convex curve 18 has a staggered cascading configuration in order to provide lanes that are equal in length. Oval track 14 surrounds numerous separate designated areas for throwing and jumping field events: A shot put 50A and a shot put score 50B; A javelin throw 60A and a javelin throw score 60B; 62A to 62B shows a triple jump runway, 62C shows a triple jump score/pit; 64A shows a long jump runway, 64B shows a long jump score/pit. All scoring areas of heretofore mentioned field events include attainable world record scores. 80A to 80D are relay runners waiting zones placed on the outer perimeter of oval track 14, on the four corners of game board 12.

referring now to FIG. 1, FIG. 2

Lanes of oval track 14, detour 30, and offshoot 16 are divided into rectangles or stride spaces. Numerous stride spaces have symbols 20 to 38 inscribed on them. Starting blocks 20A to 20F are starting blocks for numerous running events. Steeplechase detour arrow symbols 32A to 32D direct players to and from an optional steeplechase pathway detour 30, depending on the running event being played. Symbols 22 to 29, 34 to 38 are symbols that whenever landed on by a player, a particular action is required; those actions will be explained further into this description. The board game 12 has two levels of competition; division one 70A, and division two 70B are inscribed on the game board 12.

referring now to FIG. 3

FIG. 3 shows a team of four relay runner figurines that represent one player. One team is of one color. Each runner figurine is identified by a distinctive mathematical formula being inscribed on a side. There are four teams to represent four players. All four teams share the same set of four distinctive mathematical formulas for identification. Four teams are of four distinctive colors. Runners are made of plaster.

Figure 4A:
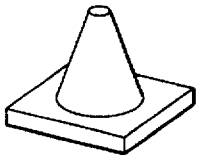
FIG. 4A to 4B shows a perspective and a side view of a cone-shaped field event score marker playing piece.
Figure 4B:
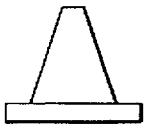

FIG. 4A to FIG. 4B shows one of four cone-shaped field event score markers. Made of plaster, each is distinctively colored.

Figure 5A:
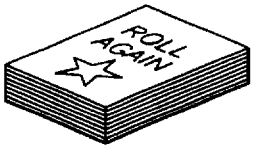
FIG. 5A to 5B shows a set of track star chance/challenge cards.
Figure 5B:
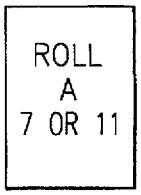

FIG. 5A, FIG. 5B shows a set of two sided track star chance/challenge cards. An obverse side FIG. 5A shows a star and the words, track star. The opposite side FIG. 5B shows an inscribed statement presenting a chance/challenge.

Listed below, as (a to l), are the chance/challenges inscribed on the cards of FIG. 5B that begin with the phrase, "roll again move only if you roll a . . . "

| | |
|---|---|
| (a) . . . No. 2,3,4,5 | (b) . . . No. 3,4,5,6 |
| (c) . . . No. 4,5,6,7 | (d) . . . No. 5,6,7,8 |
| (e) . . . No. 6,7,8,9 | (f) . . . No. 7,8,9,10 |
| (g) . . . No. 8,9,10,11 | (h) . . . No. 9,10,11,12 |
| (i) . . . double | |
| (j) . . . double and add 10 strides to that or move 3 strides instead. | |
| (k) . . . No. 7 or 11 | |
| (l) . . . double and advance to the next star symbol or move three strides instead. | |

Listed below (m, n, o) are also inscribed on cards FIG. 5B.

(m) roll again (n) V.I.P. move to the next star symbol, if there is no star before you finish, do not move.

(o) roll again once. You are a world record holder of this event if you finish in first place.

Figure 6A:
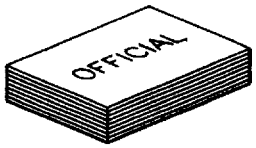
FIG. 6A to 6D shows two sets of chance cards; official and coach respectively.
Figure 6B:
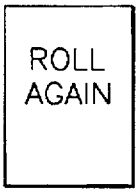

FIG. 6A to 6B shows a set of official chance cards. Two sided cards, an obverse side FIG. 6A shows the word, official. An opposite side FIG. 6B shows an inscribed statement presenting a chance.

Listed below are the chances inscribed on official cards of FIG. 6B.

(a) you test positive for illegal steroids; lose −1 turn (b) interference pushing your competition causing them to fall; lose −1 turn (c) top speed; +1 roll again (d) meet record pace; +1 roll again (e) excellent lane choice; advance 3

(f) good luck; advance 3

(g) major sponsor endorsement; advance 3

(h) a smooth dry track is a need for speed; advance 3

(i) point one zero reaction time out the blocks; advance 3

(j) good warm weather; advance 3

(k) a one point nine gust of wind is pushing you forward; advance three.

(l) the wind is pushing you back; go back 3

(m) you stepped out of your lane; go back 3

(n) Gambler! a track star cannot place any bets on the track meet; go back 3

(o) bad sportsman like conduct; go back 3

(p) your medication is not approved by track star officials; go back 3

(q) damaged lane; go back 3

(r) false start; all runners go back 3

(s) power booster; advance 7 strides (t) photo finish; keep this card until the event is over, when you land 1 or 2 strides away from the finish, this technical photo shows that you have actually reached the finish.

Figure 6C:
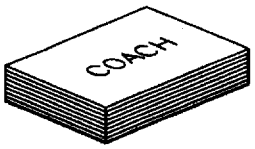
Figure 6D:
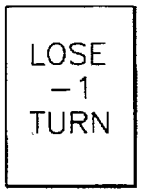

FIG. 6C to 6D shows a set of coach chance cards. Two sided cards, an obverse side FIG. 6C shows the word, coach. An opposite side FIG. 6D shows an inscribed statement presenting a chance.

Listed below are the chances inscribed on coach cards of FIG. 6D.

(a) food poisoning; lose −1 turn (b) hamstring muscle pull; lose −1 turn (c) good diet carbohydrate before competition; +1 roll again (d) top speed; +1 roll again (e) professional running shoes; advance 3

(f) excellent breathing technique; advance 3

(g) weight lifting training; advance 3

(h) stretching is essential; advance 3

(i) good attitude; advance 3

(j) self discipline and control; advance 3

(k) good running form knee lift; advance 3

(l) holding your breath while running; go back 3

(m) a wet track is slippery; go back 3

(n) shin splints leg pain; go back 3

(o) sprained ankle go back 3

(p) damaged running shoes; go back 3

(q) 20 pounds over weight; go back 3

(r) bad running form; go back 3

(s) power booster; advance 7 strides (t) Lean! keep this card until the event is over when you land one or two strides away from the finish, you may lean to advance and complete the event.

Figure 7:
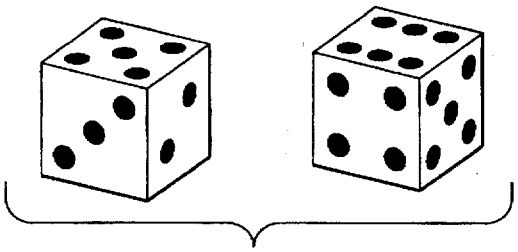
FIG. 7 shows a pair of dice.

FIG. 7 shows a pair of dice.

Figure 8:
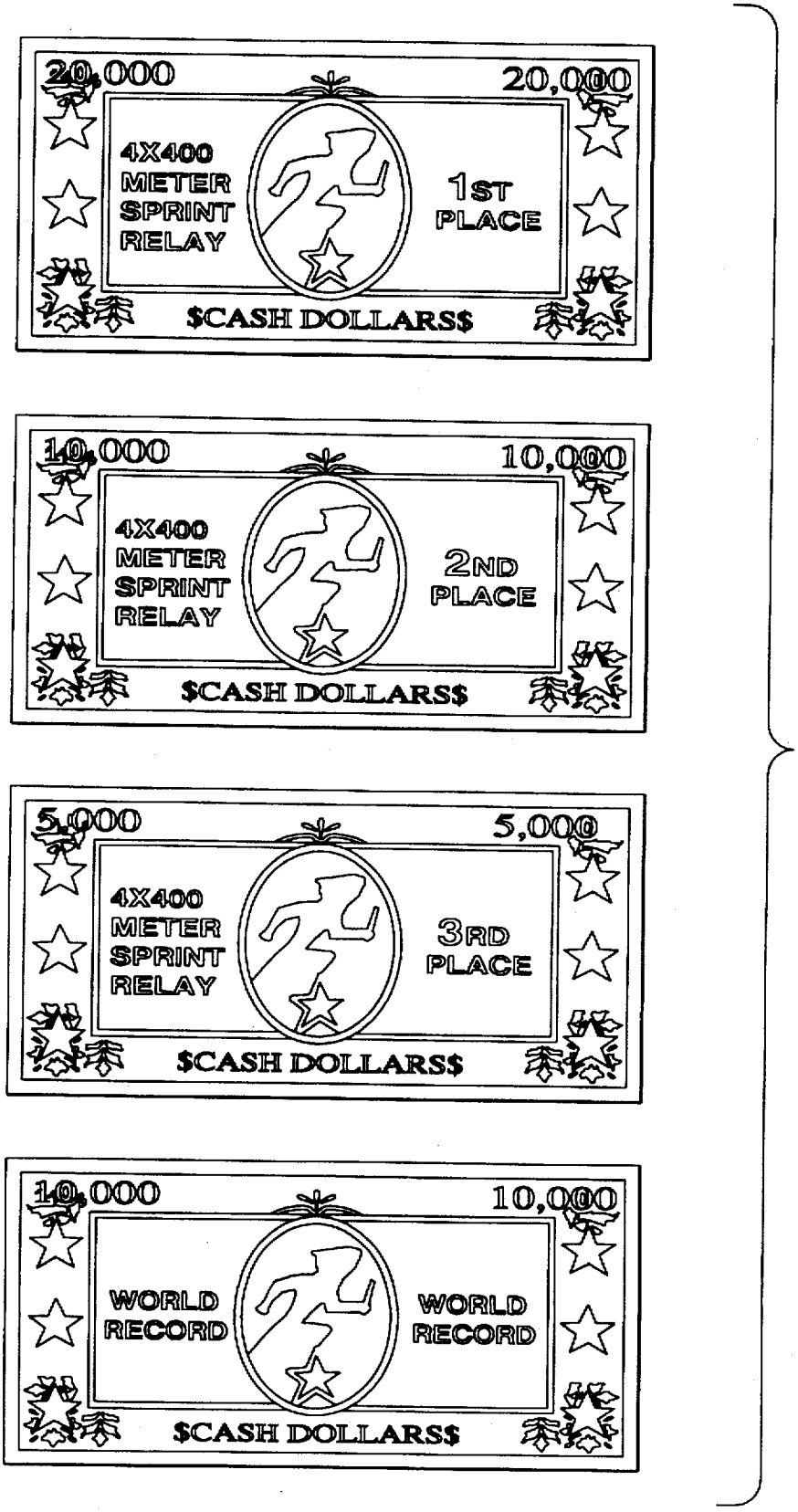
FIG. 8 shows a winners purse of play money/track meet event schedule planner.

FIG. 8 shows four simulations of numerous cash dollars. A winners purse of play money comprising: A distinctive name of the event played; A drawing of a relay runner of FIG. 3; The words, "non-negotiable"; and denominations of 20,000 for first place, 10,000 for second place, 5,000 for third place, and 10,000 bonus dollars for a world record holder. A total of about one million simulated cash dollars.

Game Objective

The object of the game is to be a world record-first place finisher, or a first, second or third place finisher in each event of a track meet, thereby collecting cash dollars from a winner's purse of play money. The player having collected the most play money at the end of the last event of the track meet, is the winner of the game.

Method of Play

To begin, players decide which events will be played to form a track meet. All events are optional except a minimum of at least one relay event must be included. Players stack the winner's purse of play money FIG. 8 in a proper order of events to be played, as will be distributed to the winners of each event. This will form a track meet events schedule plan because; the name of each event is shown on the play money of FIG. 8. Place world record bonus dollars in a separate stack.

Choose a level of competition; Division one 70A of FIG. 1 and FIG. 2, in which a player is not permitted to roll a pair of dice FIG. 7 again if a double is rolled; or division two 70B of FIG. 1 and FIG. 2, which allows a player to roll the dice again if a double is rolled.

All players roll the dice of FIG. 7 once. The highest roller goes first and has first choice of a team of four runners FIG. 3A to FIG. 3D, and lane choice of track pathway 14 of FIG. 1. In case of a tie, players with the same like numbers roll again to decide the player going next.

Figure 3A:
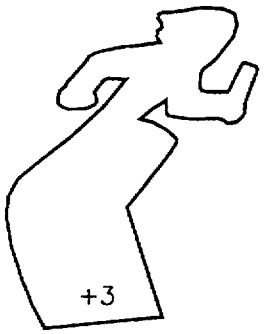
FIG. 3A to 3D shows a side view of a team of four relay runner figurines.
Figure 3B:
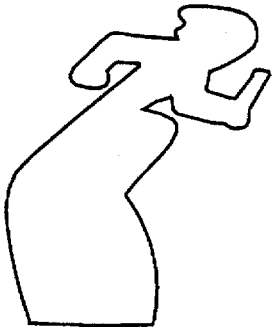
Figure 3C:
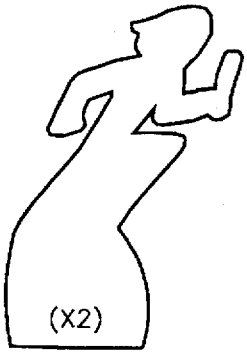
Figure 3D:
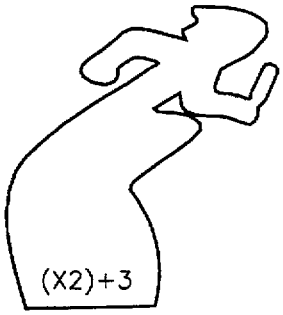

To play a solo running event, players use a solo runner FIG. 3B having a blank, or no identification math formula. Place solo runner on a proper starting block 20A to 20F of FIG. 1 and FIG. 2, in accordance with the event being played. Roll a pair of dice FIG. 7. Move the runner FIG. 3B counter clockwise the amount of stride spaces equaling the numbers appearing on the dice. Pay close attention to the symbols 22 to 38 of FIG. 1 and FIG. 2, that are inscribed on track 14, detour 30, and offshoot 16. These symbols require a particular action to be taken whenever landed on by a runner FIG. 3A to FIG. 3D.

Listed below are the definitions of symbols 22 to 29, 34 to 38 of FIG. 1, and FIG. 2, and the action to be taken when landed on.

(a) roll again 22; allows a player to roll the dice of FIG. 7 again.

(b) lose one turn 24; requires a player to lose one turn (c) official 26; requires a player to take one official card of FIG. 6A and FIG. 6B.

(d) coach 28; requires a player to take one coach card of FIG. 6C and FIG. 6D.

(e) track star 29; requires a player to take one track star card of FIG. 5A and FIG. 5B.

(f) hurdle 34; is not to be counted as stride spaces unless a hurdle event or steeplechase is being played, otherwise it requires a player to move backward three stride spaces.

(g) triple hurdle 36; a player must move backward three stride spaces.

(h) water-pool 38; requires a player to move backward four stride spaces.

Starting blocks 20A to 20F of FIG. 1 and FIG. 2, are not to be counted as strides.

Try to reach the finish line 46 or 17 of FIG. 1 before the competition. Distribute the winner's purse FIG. 8 to; the world record first, first, second, and third place finishers. The next event showing on the pre-stacked winner's purse FIG. 8, will be the next event to play.

Track offshoot 16 of FIG. 1, is used for the 60 meter sprint and hurdles, the 100 meter sprint and hurdles, using starting block 20E of FIG. 1 and FIG. 2. Finish line 46 of FIG. 1 is used for the 60 meter sprint and hurdles. Finish line 17 of FIG. 1 is used for the 100 meter sprint and hurdles, moving through and ignoring the first finish line 46 of FIG. 1.

There are numerous solo running events possible to play. Listed below are solo running events on oval track 14 of FIG. 1, steeplechase detour 30 of FIG. 1, and the starting blocks 20A to 20D, 20F of FIG. 1 and FIG. 2 used accordingly. Each event has a common finish line 46 of FIG. 1:

| solo running event | starting block 20A to 20D, 20F of FIGS. 1 and 2 |
|---|---|
| (a) 400 meter sprint | 20A |
| (b) 400 meter hurdles | 20A |
| (c) 400 meter steeplechase | 20A |
| (d) 300 meter sprint | 20B |
| (e) 300 meter hurdles | 20B |
| (f) 300 meter steeplechase | 20F |
| (g) 200 meter sprint | 20C |
| (h) 200 meter hurdles | 20C |

To play a steeplechase event, hurdles 34 and 36 of FIG. 1 and FIG. 2 are counted as strides. Follow arrows 32A to 32D of FIG. 1 and FIG. 2, to and from steeplechase detour track 30 of FIG. 1. Pay close attention to the symbols 22 to 38 of FIG. 1 and FIG. 2. Try to reach a common finish line 46 of FIG. 1 before the competition.

To play a running relay event on track 14, and or detour 30 of FIG. 1:

All players strategically place each relay runner of a team FIG. 3A to FIG. 3D, on a starting block 20A to 20D of FIG. 1 and FIG. 2. Relay runner's waiting zone 80A to 80D of FIG. 1, are used as temporary places for a relay runner of FIG. 3A to FIG. 3D, to wait until the oval track 14 of FIG. 1 is clear of the previous relay runner of FIG. 3A to FIG. 3D; in order to be placed on a proper starting block 20A to 20D of FIG. 1 and FIG. 2, depending on the relay event being played.

The first place finisher of the previous event goes first by rolling a pair of dice FIG. 7. Start with the distinctive identification mathematical formula of the first relay runner, of FIG. 3A to FIG. 3D. Apply that formula to; the numbers appearing on the dice of FIG. 7. Move the runner the amount of strides equaling the sum of; the numbers appearing on the dice FIG. 7, as applied to the math formula of the runner of FIG. 3A to FIG. 3D. If the runner FIG. 3B, has no identification math formula or has a blank, move the runner the amount of strides equaling; the numbers appearing on the dice FIG. 7, only.

Pay close attention to the symbols 22 to 38 of FIG. 1 and FIG. 2, being inscribed on track 14 of FIG. 1, and detour 30 of FIG. 1.

The object of the first runner of FIG. 3A to FIG. 3D, is to reach the second runner of FIG. 3A to FIG. 3D, so as to hand off. When the first runner reaches the second runner to hand off, switch to the distinctive identification math formula of the second runner of FIG. 3A to FIG. 3D. That formula will be applied to any unused or left-over stride spaces of the preceding first runner of FIG. 3A to FIG. 3D. This will enable the second runner to move the amount of stride spaces equaling; the sum of the identification math formula of the second runner, as applied to the unused hand off strides of the first runner FIG. 3A to FIG. 3D. In case a relay runner has zero unused hand off strides for a subsequent runner, the subsequent runner will not be moved until the next turn or roll of the dice FIG. 7. (Using this method of movement, empowers four relay runners to move at four distinctive paces or rates of speed; slow, fast, faster, fastest, therefore adding excitement and realism to the game.)

The object of the second runner, is to reach the third runner of FIG. 3A to FIG. 3D. The object of the third runner, is to reach the fourth runner of FIG. 3A to FIG. 3D. The object of the fourth runner, is to reach the finish line 46 of FIG. 1. The event is over when the fourth runner of each player has reached the finish line 46 of FIG. 1.

A winner's purse of play money FIG. 8, is distributed to; the world record first, first, second, and third place finishers. The next event showing on the winner's purse of FIG. 8, will be the next event to be played.

Listed below are numerous relay events of track 14 of FIG. 1, and detour 30 of FIG. 1. The proper starting blocks 20A to 20D of FIG. 1 and FIG. 2, that are used to; start the first runner, hand off to the second, third, and fourth runners of FIG. 3A to FIG. 3D, are also listed accordingly:

| relay event | starting blocks 20A t0 20D of FIGS. 1 and 2 |
|---|---|
| (a) 4 × 100 meter sprint relay, 4 × 100 meter hurdles relay, 4 × 100 meter steeplechase relay | 20A, 20B, 20C, 20D |
| (b) 4 × 200 meter spring relay, 4 × 200 meter hurdles relay, 4 × 200 meter steeplechase relay | 20A, 20C, 20A, 20C |
| (c) 4 × 300 meter spring relay, 4 × 300 meter hurdles relay, 4 × 300 meter steeplechase relay | 20A, 20D, 20C, 20B |
| (d) 4 × meter sprint relay, 4 × 400 meter hurdles relay, 4 × 400 meter steeplechase relay | 20A, 20A, 20A, 20A |

Relay events have a common finish line 46 of FIG. 1.

Referring now to all running events heretofore mentioned: A player's turn is over when;

(a) a chance card of FIG. 5A to FIG. 6D has been chosen that prevents any further movement, or (b) a runner of FIG. 3A to 3D lands on a blank stride space, and or, (c) the game is being played on competition level; division two 70B of FIG. 1 and FIG. 2, and the player has not rolled a double.

A player must then, give the dice FIG. 7, to the next player.

Field events:

To play the shot put 50A to 50B of FIG. 1. A player places a runner of FIG. 3B on the throw area 50A. Roll the dice FIG. 7 twice. Take the highest of the two rolls and place a marker FIG. 4A to FIG. 4B, on the corresponding score 50B.

To play the javelin throw 60A to 60B of FIG. 1. A player places a runner FIG. 3B, in the throwing area 60A. Roll a pair of dice FIG. 7, twice. Add them together then multiply by two. Place a marker FIG. 4A to FIG. 4B, on the corresponding score 60B.

Referring to the heretofore mentioned shot put 50A to 50B, and the javelin throw 60A to 60B; If a runner FIG. 3B, is not placed in the throw area 50A of FIG. 1, or the throwing area 60A when the dice are rolled, that player has fouled and loses that turn.

To play the triple jump. A player places a runner FIG. 3B on a starting block 20G of FIG. 1 and FIG. 2. Roll a pair of dice FIG. 7, three times. Combine the total of the three rolls. Move the runner FIG. 3B, the amount of spaces on runway 62A to 62B, and score pit 62C, equaling the sum of the combined three rolls of the dice. When a player lands on a number of ft. jumped on the score pit 62C, place a marker of FIG. 4A to FIG. 4B, on the corresponding number of ft. jumped on the score pit 62C, to mark a score.

To play the long jump 64A to 64B of FIG. 1. A player places a runner FIG. 3B, on the starting block 20H. Roll a pair of dice FIG. 7 twice. Move the runner on the long jump 64A to 64B, the amount of spaces equaling the sum of the combined two rolls of the dice FIG. 7. Place a marker FIG. 4A to FIG. 4B on the corresponding number of ft. jumped on the score pit 64B, to mark a score.

Referring to the heretofore mentioned triple jump 62A to 62C, and the long jump 64A to 64B: If a player does not reach the score pit 62C of FIG. 1, or the score pit 64B, that player has fouled and loses that turn.

Referring now to all the heretofore mentioned field events 50A to 64B of FIG. 1: Each player has three turns or plays. A player's highest score out of three plays; is a player's final score. If a player attains a world record score, that player receives world record bonus dollars from the winner's purse FIG. 8, immediately. The player with the highest final score, is the first place finisher. The second highest scorer is the second place finisher. The third highest scorer is the third place finisher.

In case of a tie: Those players sharing identical final scores, must participate in another turn, or tie breaker of the field event tied. The highest scorer of the tie breaker, precedes as designated place finisher of the tied players.

All designated place finishers receive play money from the winner's purse of FIG. 8.

The track meet is over when the pre-stacked winner's purse of play money/track meet events schedule plan FIG. 8, has been distributed to all designated place finishers.

The player with the most play money FIG. 8, is the winner of the game.

In case of a tie, an optional tie breaker so as to decide the winner of the game would be; Those players holding the same like amounts of play money of FIG. 8, would choose an event of the game board 12 of FIG. 1, and play or replay it.

Summary, Ramifications, and Scope

The board game of my invention simulates the current sport of professional track and field in fine detail. The track resembles that of a real track stadium. It has starting blocks, a steeplechase detour, hurdles placed throughout various zones of the track for numerous hurdling events, triple jump, and a javelin throw. It features over 24 events to be played. The main attraction of playing this board game, is the relays. The relay runner figurines are labeled with distinctive identification math formulas. These formulas are applied to; the numbers appearing on the dice. This enables all runners of a team, to move at distinctive rates of speed, and to hand off to a faster, slower, or fastest runner.

While my above description contains many specificities, these should not be construed as limitations on the scope of the invention, but rather as an exemplification of one preferred embodiment thereof. Many other variations are possible.

For example;

(a) the distinctive identification math formulas of relay runners, could be substituted by various other math formulas.

(b) the statements inscribed on the chance cards, could be presented in a variety of ways using a variety of numbers.

(c) the play money could be of various denominations (d) the runner figurines could be made of various other hard materials, such as; wood, die cast metal, glass, plastic (etc.)

(e) the number of strides required to move backward, after landing on a hurdle, could be substituted by various numbers.

(f) the designated areas for field events could be of various shapes and sizes.

Accordingly, the scope of the invention should be determined not by the embodiments illustrated, but by the appended claims and their legal equivalents.

I claim:

1. A board game to simulate professional track and field sports competition comprising:

a playing board having a generally oval shaped track with a plurality of lanes being equal in length, for a plurality of players, having two straight sides and two convex curves, one said straight side having an offshoot of said lanes, providing a secondary finish line for a 100 meter sprint and a 100 meter hurdles, one said convex curve having a staggered cascading configuration so as to provide a common primary finish line for a plurality of running relay events;

a detour of said lanes providing a steeplechase, being surrounded by and adjacent to said oval track;

a plurality of starting blocks being inscribed on said lanes;

a plurality of symbols representing numerous chances, being inscribed on said lanes;

a plurality of chance cards being represented by said symbols;

a plurality of areas providing field events being surrounded by said track;

a plurality of teams of four relay runner figurines, representing players so as to be moved on said playing board;

a pair of dice providing numbers, means for movement of said relay runner figurines;

a plurality of distinctive mathematical formulas comprising;

numerous groups of four, being inscribed on said relay runners, so as to be multiplied and added with said numbers of said dice;

a plurality of play money, to award players.

2. The board game of claim 1, wherein said dice are rolled three times and said numbers are combined to make a triple jump, said dice are rolled twice and said numbers are combined to make a long jump, said dice are rolled twice and said numbers are combined and multiplied by two, to make a javelin throw.

3. The board game of claim 1, further including representation of chances; lose one turn, roll again, go backward three spaces for a plurality of hurdles, and go backward four spaces for a plurality of water pools.

4. The board game of claim 1, wherein numerous names of track and field events are inscribed, providing a track meet schedule of events comprising; a minimum of one running relay event, whereby a complete simulation of professional track and field sports can be played.

* * * * *